US006988310B2

(12) United States Patent
Advocate, Jr. et al.

(10) Patent No.: US 6,988,310 B2
(45) Date of Patent: Jan. 24, 2006

(54) METHOD OF ASSEMBLING AN INTERCONNECT DEVICE ASSEMBLY

(75) Inventors: Gerald G. Advocate, Jr., Pleasant Valley, NY (US); Norman D. Curry, Poughkeepsie, NY (US); Francis Krug, Highland, NY (US); David C. Long, Wappingers Falls, NY (US); Daniel O'Connor, Millbrook, NY (US); Charles Hampton Perry, Poughkeepsie, NY (US); Robert Weiss, LaGrangeville, NY (US)

(73) Assignee: International Business Machines Corporation, Armonk, NY (US)

( * ) Notice: Subject to any disclaimer, the term of this patent is extended or adjusted under 35 U.S.C. 154(b) by 261 days.

(21) Appl. No.: 10/187,081

(22) Filed: Jun. 28, 2002

(65) Prior Publication Data

US 2004/0002233 A1 Jan. 1, 2004

(51) Int. Cl.
*H01R 43/00* (2006.01)

(52) U.S. Cl. ..... 29/825; 29/874; 29/884; 439/66

(58) Field of Classification Search ..... 29/825, 29/829, 830–834, 846–847, 874, 882; 439/66, 439/67, 561; 174/250, 260; 257/712; 438/771
See application file for complete search history.

(56) References Cited

U.S. PATENT DOCUMENTS

| | | | | |
|---|---|---|---|---|
| 4,988,306 | A * | 1/1991 | Hopfer et al. | 439/66 |
| 5,127,837 | A * | 7/1992 | Shah et al. | 439/71 |
| 5,359,488 | A | 10/1994 | Leahy et al. | |
| 6,062,870 | A | 5/2000 | Hopfer, III et al. | |
| 6,449,840 | B1 * | 9/2002 | Le et al. | 29/852 |
| 6,695,623 | B2 * | 2/2004 | Brodsky et al. | 439/66 |

OTHER PUBLICATIONS

Metreaud et al., IBM Technical Disclosure Bulletin, vol. 20, No. 7, p. 2695, (Dec. 1977).

* cited by examiner

*Primary Examiner*—Minh Trinh
(74) *Attorney, Agent, or Firm*—Ira D. Blecker

(57) ABSTRACT

A method of assembling an interconnect device assembly which consists of cylindrical resilient wire bundles captured within a carrier. In a step of the method, the interconnect device assembly is placed in a fixture and the ends of the resilient wire bundles are deformed by shaping dies in the fixture so that the resilient wire bundles now have a dog bone shape. The dog bone shape of the resilient wire bundles prevents the resilient wire bundles from being partially or totally dislodged during handling and transit.

9 Claims, 5 Drawing Sheets

METHOD OF ASSEMBLING AN INTERCONNECT DEVICE ASSEMBLY

BACKGROUND OF THE INVENTION

The present invention relates to electrical interconnects and, more particularly, relates to the assembly of electrical interconnects incorporating an interposer having resilient wire bundles that provide a conductive path between two electronic substrates. The present invention further particularly relates to apparatus involved in the assembly of such electrical interconnects.

Electrical interconnect devices having resilient wire bundles for providing a conductive path between two electronic substrates are well known to those skilled in the art. Such resilient wire bundles are also known as fuzz buttons, button contacts, button wads or contact wads and shall be collectively referred to hereafter as resilient wire bundles.

One such device is the electrical interconnect device shown in Hopfer, III et al., the disclosure of which is incorporated by reference herein. There, it can be seen that resilient wire bundles are held in a carrier. In use, the carrier is placed between two circuit boards and the resilient wire bundles provide the conductive path between the two circuit boards, As noted in Hopfer, III et al., the resilient bundles wire (contact wads) are held in place in the carrier in their corresponding holes by compressive radial frictional engagement with the side walls of each of the holes.

Metreaud et al. IBM Technical Disclosure Bulletin, vol. 20, no. 7, p. 2695 (December 1977) discloses another use of a resilient wire bundle (fuzz button) in which a depression is formed in the resilient wire bundle to accommodate a chip. The compressed portion of the resilient wire bundle enhances the thermal conductivity of the resilient wire bundle for better cooling of the chip.

Leahy et al. U.S. Pat. No. 5,359,488, the disclosure of which is incorporated by reference herein, discloses another use of a resilient wire bundle (fuzz button) which interconnects a radio frequency package to a ceramic motherboard.

The inherent difficulty with such interconnect devices that use a resilient wire bundle for a conductive path is that the resilient wire bundle is frequently jarred loose from the carrier during transit or handling such that when the interconnect device is placed between two electronic substrates, an open results due to the missing resilient wire bundle. This unfortunate circumstance occurs notwithstanding the teachings of Hopfer, III et al. that the resilient wire bundles are force fitted into the holes in the carrier. When such an open occurs, the interconnect device has to be replaced at some additional cost. Instead of being jarred loose from the carrier, the resilient wire bundle instead could be partially jarred from the carrier such that when the resilient wire bundle is compressed between the two electronic substrates, the resilient wire bundle bends over and makes contact with an adjacent resilient wire bundle causing a short circuit which can result in damage to one of both of the electronic substrates being interconnected. In this latter situation as well, the resilient wire bundle, and possibly also one or both of the electronic substrates being interconnected, would have to be replaced at some additional cost.

In order to remedy the shortcomings of the prior art, it is a purpose of the present invention to have a method of assembling the interconnect device in which the resilient wire bundles are prevented from being jarred loose during handling and transit of the interconnect device.

It is a further purpose of the present invention to have an apparatus for assembling an interconnect device in which the resilient wire bundles are prevented from being jarred loose during handling and transit of the interconnect device.

These and other purposes of the present invention will become more apparent after referring to the following description of the invention considered in conjunction with the accompanying drawings.

BRIEF SUMMARY OF THE INVENTION

The purposes of the invention have been achieved by providing, according to a first aspect of the present invention, a method of assembling an interconnect device, the method comprising the steps of:

obtaining a resilient wire bundle having first and second ends and a carrier having a perforation for receiving the resilient wire bundle and a resilient wire bundle in the perforation; and contacting the first and second ends of the resilient wire bundle with a shaping die so as to increase a cross-sectional area of the resilient wire bundle to thereby form the resilient wire bundle into a dog bone shape and retain the resilient wire bundle in the perforation.

According to a second aspect of the present invention, there is provided an interconnect device assembly fixture comprising:

a first die assembly comprising a first stripper plate having a perforation therein and a first shaping die slidably engaged in the first stripper plate perforation wherein the first shaping die is capable of extending past a working side of the first stripper plate;

a second die assembly comprising a second stripper plate having a perforation therein and a second shaping die slidably engaged in the second stripper plate perforation wherein the second shaping die is capable of extending past a working side of the second stripper plate;

the first and second die assemblies being in opposed, spaced apart relation such that the working side and shaping die of the first die assembly face and do not contact the working side and shaping die of the second die assembly;

wherein, in operation, a carrier having resilient wire bundles is placed between the respective working sides of the first and second die assemblies and the respective shaping dies are caused to contact the resilient wire bundles so as to increase a cross-sectional area of the resilient wire bundles and thereby retain them in the carrier.

According to a third aspect of the present invention, there is provided a method of assembling a plurality of shaping dies, the method comprising the steps of:

placing a plurality of shaping dies in perforations in a die block so that the plurality of shaping dies protrude from the die block;

adjusting the shaping dies so that they all protrude the same amount from the die block;

permanently fixing the shaping dies in the die block.

BRIEF DESCRIPTION OF THE DRAWINGS

The features of the invention believed to be novel and the elements characteristic of the invention are set forth with particularity in the appended claims. The Figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

Figure 7A:
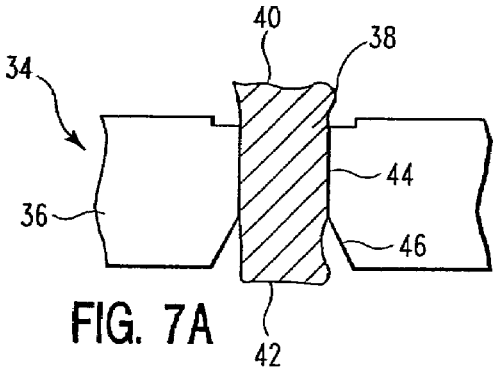
FIG. 7A illustrates a resilient wire bundle in a carrier.
Figure 7B:
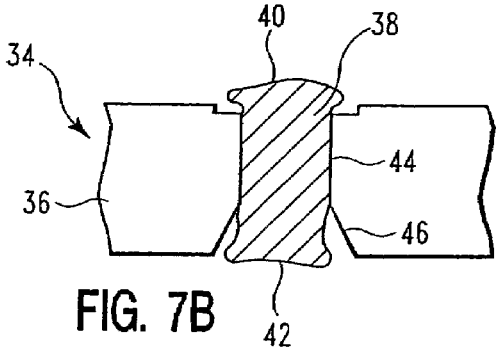
FIG. 7B illustrates the resilient wire bundle of FIG. 7A formed into a dog bone shape according to one method step of the invention.
Figure 7C:
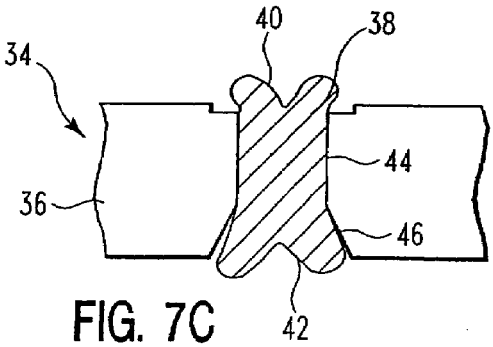
FIG. 7C illustrates the resilient wire bundle of FIG. 7A formed into a dog bone shape according to another method step of the invention.

Referring to the Figures in more detail, and particularly referring to FIGS. 7A to 7C, there is shown in FIG. 7A an interconnect device assembly 34 comprising carrier 36 having a perforation 44 for receiving a resilient wire bundle 38. A portion 46 of perforation 44 may be tapered for the purpose of inserting resilient wire bundle 38 in the perforation 44. Typically, the carrier 36 and resilient wire bundle 38 are purchased as an interconnect device assembly 34 from a manufacturer, of which there are many. One such manufacturer is Cinch Connectors Inc., Lombard, Ill. Further, while FIG. 7A only shows one resilient wire bundle in the carrier 36, it should be understood that there will usually be many such resilient wire bundles 38 in the carrier 36 to make up interconnect device assembly 34.

A problem with interconnect device assembly 34 is that the normally cylindrically-shaped resilient wire bundle 38 may be partially or totally dislodged from the carrier 36 during handling or transit as mentioned previously. The present invention, therefore, is directed to securing the resilient wire bundles 38 in carrier 36.

Turning now to FIG. 7B, it can be seen that resilient wire bundle 38 has been flattened at first end 40 and second end 42, by means to be discussed hereafter, into a dog bone shape that is now retained in the perforation 44 of carrier 36.

In FIG. 7C, resilient wire bundle 38 has been indented at first end 40 and second end 42, by means to be discussed hereafter, into a dog bone shape that is now retained in the perforation 44 of carrier 36.

While the process steps necessary to form the shape of resilient wire bundle 38 shown in FIG. 7B or 7C may be sufficient if used alone in one preferred embodiment of the present invention, it is another preferred embodiment of the present invention to use them in combination as will be explained in more detail hereafter.

Figure 1:
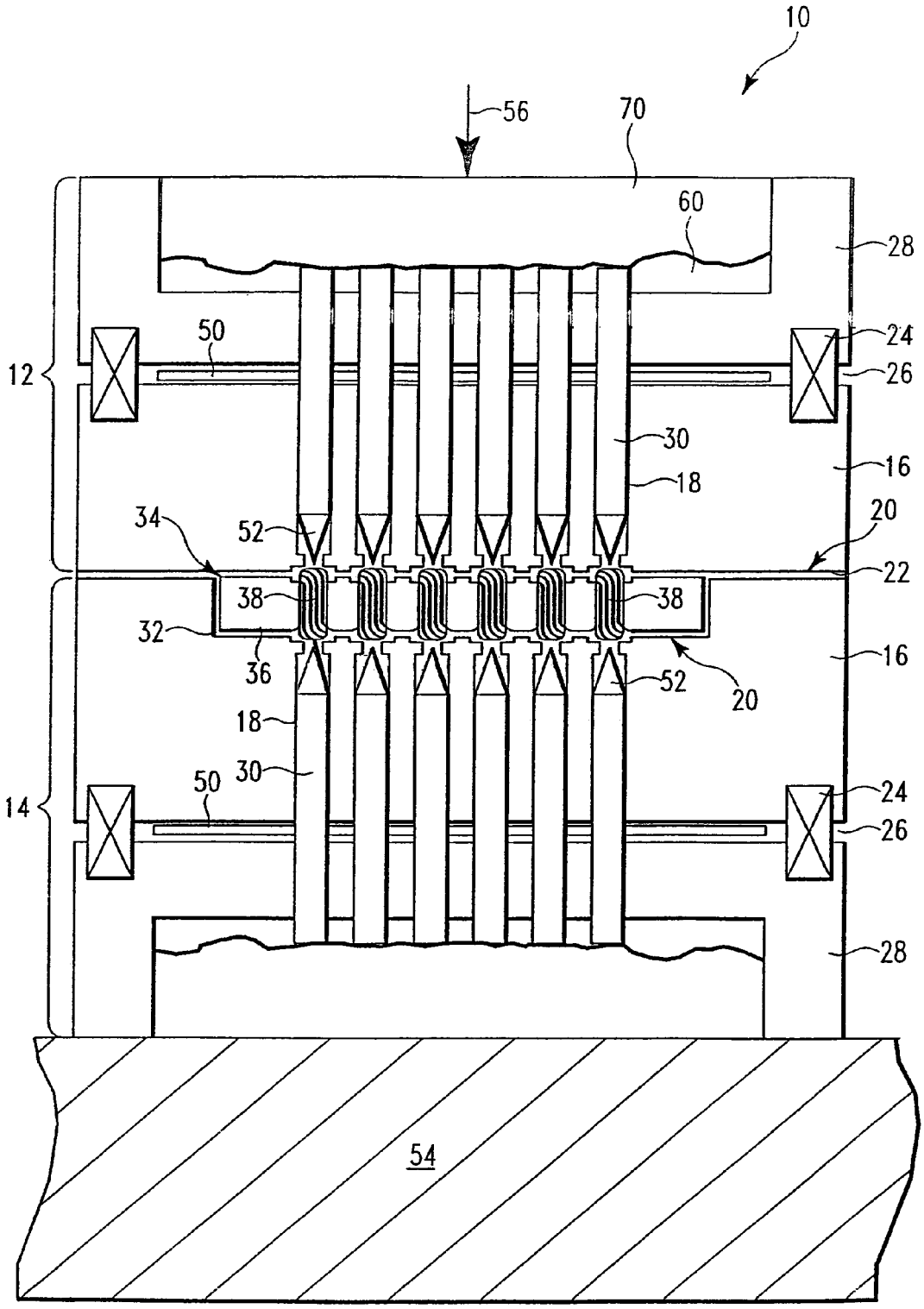
FIG. 1 is a partial cross-sectional view of an interconnect device assembly fixture according to the present invention in a first position.

Referring now to FIG. 1, there is shown a first preferred embodiment of an interconnect device assembly fixture 10 according to the present invention which will shape the resilient wire bundles 38 into the form represented by FIG. 7C. FIG. 1 shows the interconnect device assembly fixture 10 in the rest position. An interconnect device assembly 34 is placed in cavity 32 of die assembly 14. Die assembly 14 comprises a stripper plate 16 and die block 28. Contained within stripper plate 16 and die block 28 are shaping dies 30 which are slidably moveable in perforations 18 of stripper plate 16 but are fixed in die block 28 as will be explained in more detail hereafter. Shaping dies 30 preferably are round in cross-section and have pointed tips 52. Stripper plate 16 and die block 28 are spaced apart a distance 26 by biasing means 24 such as springs. Stripper plate 16 has a working side 20 which faces the interconnect device assembly 34.

Still referring to FIG. 1, interconnect device assembly fixture 10 further comprises die assembly 12 which is identical to die assembly 14 except that die assembly 12 does not contain a cavity for receiving the interconnect device assembly 34. Die assemblies 12 and 14 are spaced apart a distance 22.

Interconnect device assembly fixture 10 sits on table 54 or other rigid surface. Schematically shown as arrow 56 is a force mechanism, for example a press comprising an air cylinder and regulator, which will apply a downward force to interconnect device assembly fixture 10. As an illustration, such a press may exert a force of about 1000 pounds on an interconnect die assembly having 1500 resilient wire bundles. The interconnect device assembly fixture 10 may be assembled by placing die assembly 14 on table 54, inserting interconnect device assembly 34 into cavity 32, then placing die assembly 12 over die assembly 14. Alignment of die assemblies 12, 14 is accomplished by dowel pins (not shown) which run vertically through die assemblies 12, 14.

Figure 2:
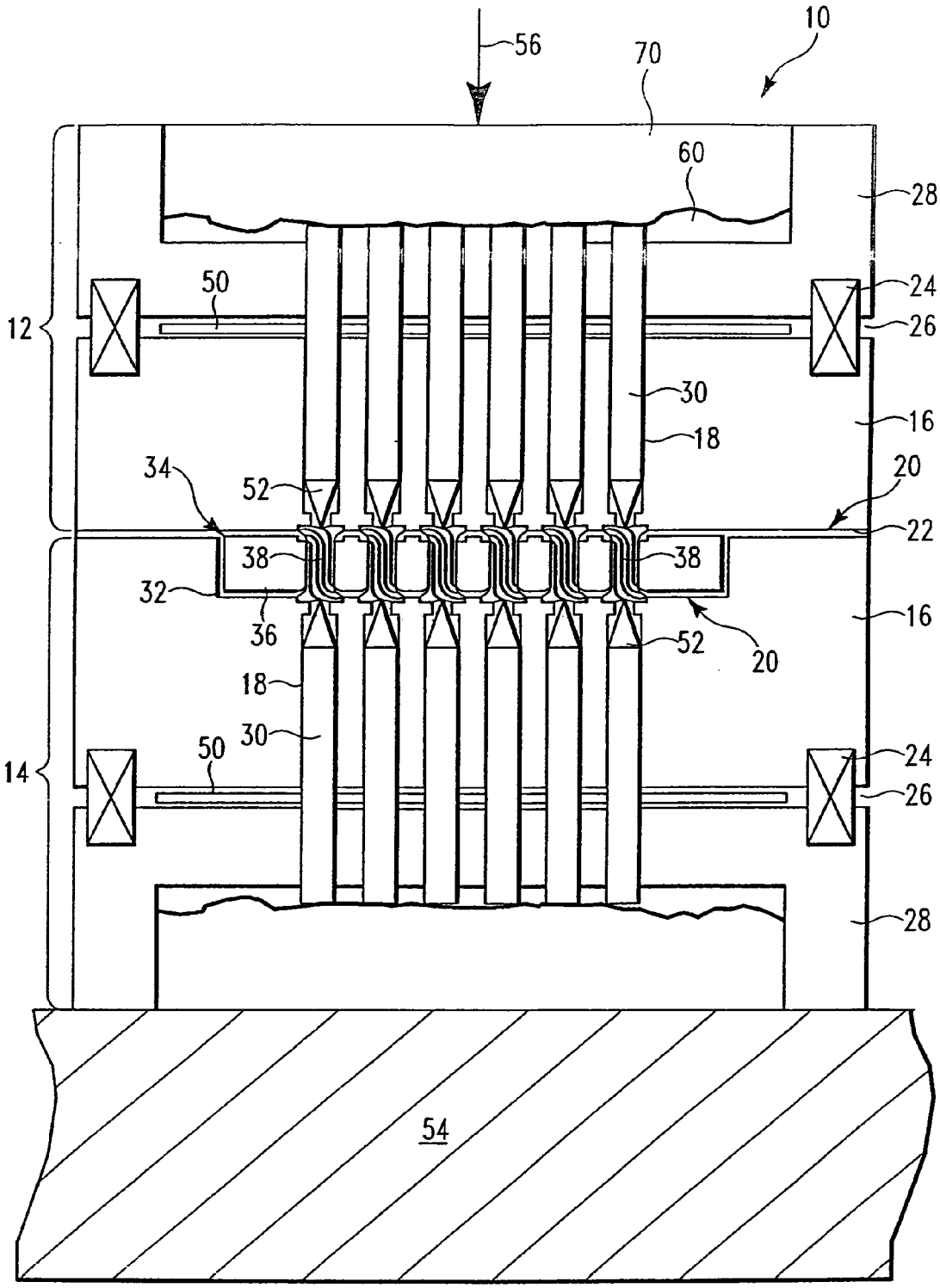
FIG. 2 is a partial cross-sectional view of the interconnect device assembly fixture of FIG. 1 in a second position.

Referring now to FIG. 2, the interconnect device assembly fixture 10 is shown in operation. Upon application of force mechanism 56, stripper plates 16 of die assemblies 12, 14 move toward each other until contact is made with the interconnect device 34. During this part of the operation, biasing means 24 keep the respective die blocks 28 apart from the stripper plates 16. Once contact of the stripper plates 16 is made with the interconnect device assembly 34, continued application of force mechanism 56 overcomes biasing means 24 such that the die blocks 28 now move toward each other and interconnect device assembly 34. Shaping dies 30 consequently also move toward and into contact with the resilient wire bundles 38. In one preferred embodiment of the present invention, the shaping dies each move about 6 mils which is sufficient to clear the stripper plate and make substantial contact with the resilient wire bundles 38 so as to effectively indent each end 40, 42 of the resilient wire bundles 38 as shown in FIG. 7C. The stroke of the die blocks 28 and hence also shaping dies 30 can be further regulated by the inclusion of shims 50 between respective die blocks 28 and stripper plates 16.

Once contact of the shaping dies 30 is made with the resilient wire bundles 38, the force mechanism 56 is relieved such that the interconnect device assembly fixture returns to its position as shown in FIG. 1. Die assembly 12 is then removed, interconnect device assembly 34 removed, another interconnect device assembly 34 is put into cavity 32 and die assembly 12 replaced to begin the process all over again.

Figure 3:
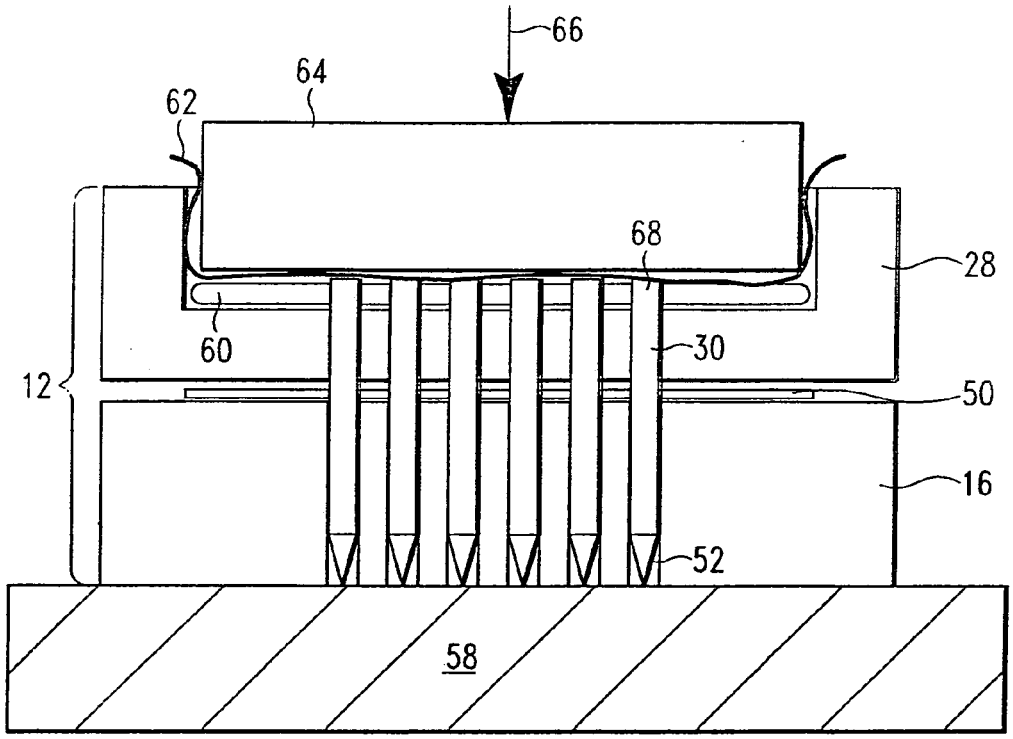
FIG. 3 is a partial cross-sectional view of a fixture for assembling a plurality of shaping dies according to the present invention.

It is advantageous for the present invention that all of shaping dies 30 extend the same distance from die block 28 so that contact with the resilient wire bundles 38 is uniform. Accordingly, a method for assembling the shaping dies 30 in die block 28 will now be described. Referring now to FIG. 3, stripper plate 16 and die block 28 are assembled on flat plate 58. Shims 50 may be inserted between stripper 16 and die block 28 if desired. Shaping dies 30 are inserted into die block 28 and then stripper plate 16 so that the tips 52 of shaping dies 30 rest on flat plate 58. Adhesive 60, preferably epoxy, is then applied to the tops 68 of shaping dies 30 followed by release layer 62 (e.g., Saran wrap) and then elastomeric pad 64. Because these shaping dies 30 can be small (on the order of 20 mils in diameter), they will float up into the adhesive 60, thereby destroying the planarity of the shaping dies 30 on flat plate 58 unless they are forced down during the curing of the adhesive 60. Thus, a force 66 is applied to elastomeric pad 64 which holds the shaping dies 30 in place. Upon curing of the adhesive 60, the force 66, elastomeric pad 64 and release layer 62 are removed. Thereafter, a second adhesive 70 (shown in FIGS. 1 and 2), preferably also epoxy, is added to fill the die block 28.

Figure 5:
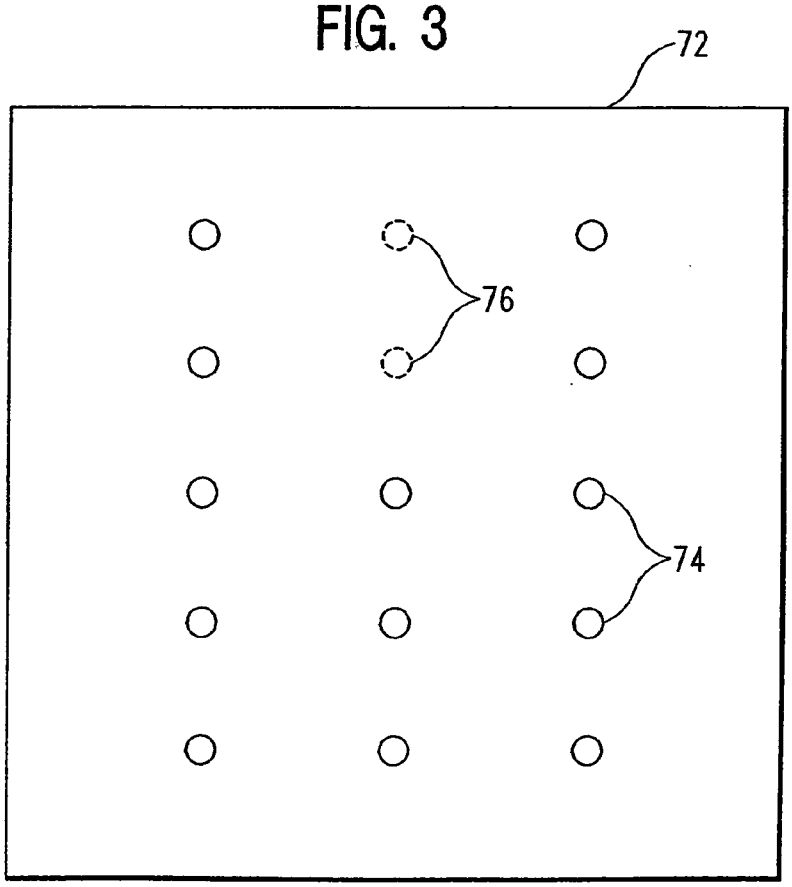
FIG. 5 is a schmatical illustration of sample output from the testing of shaping dies in the fixture of FIG. 4.
Figure 4:
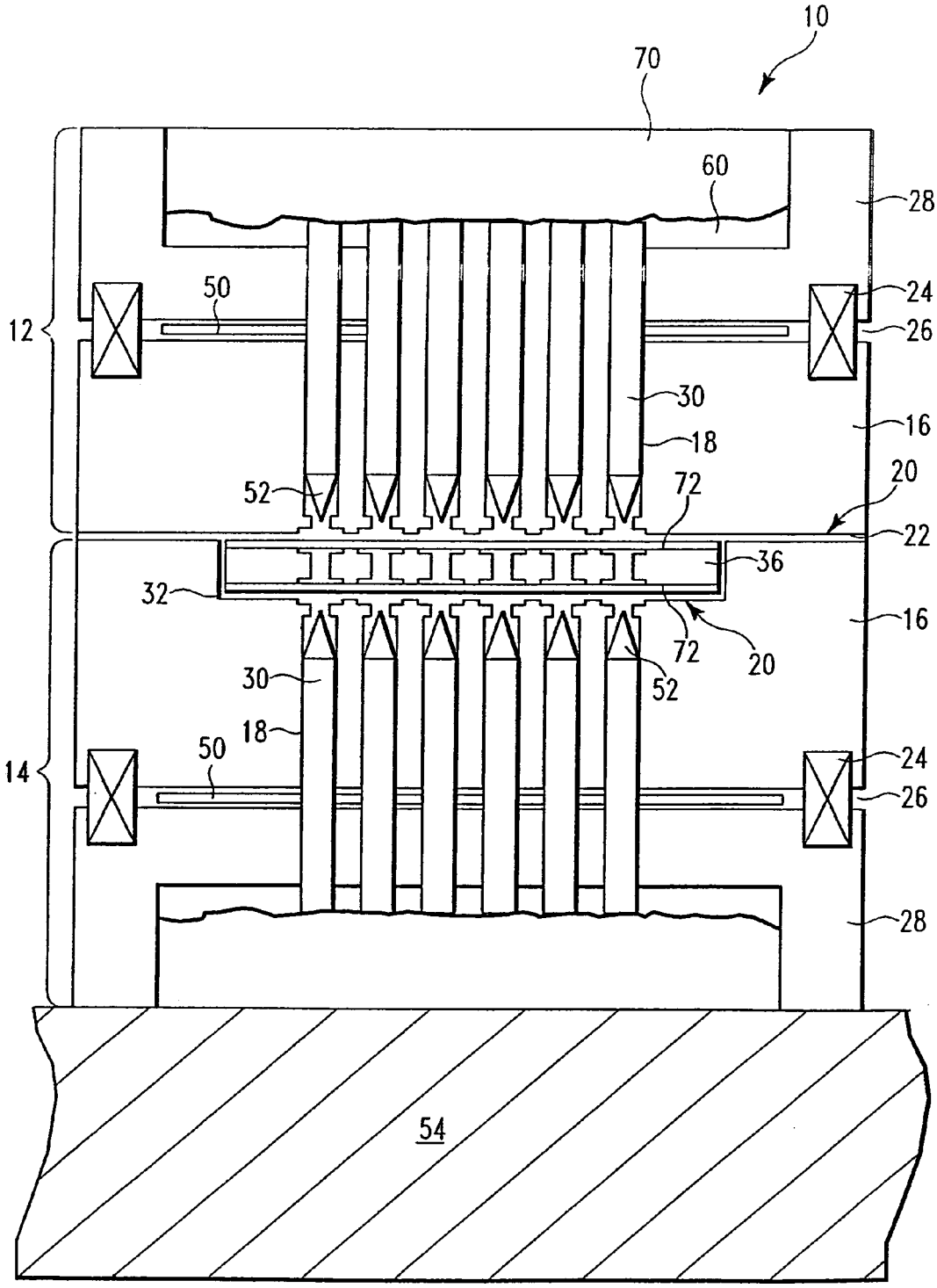
FIG. 4 is a partial cross-section of a fixture for testing the shaping dies.

From time to time, it is desirable to check the operation of the interconnect device assembly fixture 10 to make sure it is working properly. For example, the tips 52 of the shaping dies 30 could become bent, worn or broken or there could be some other problem with the device assembly fixture 10 such that there would be insufficient contact of the shaping dies 30 with resilient wire bundles 38. Accordingly, the present inventors have proposed a method of testing the interconnect device assembly fixture 10 as shown in FIG. 4. A metal sheet 72 is placed in cavity 32 of stripper plate 16 of die assembly 14. Thereafter, carrier 36 (without any resilient wire bundles) is placed on top of metal sheet 72 followed by a second metal sheet 72. Die assembly 12 is then placed over die assembly 14 and force mechanism 56 activated (as shown in FIG. 2) to move shaping dies 30 into contact with metal sheets 72. Die assembly 12 is then removed followed by removal of metal sheets 72 and carrier 36. Metal sheets 72 are then examined. The examination of the metal sheets 72 will provide information as to whether the tips 52 are defective, bent, deformed, broken, worn out or contain debris or whether there is a problem with the die assemblies 12, 14 that would allow for over-or under-penetration of the tips 52 into the resilient wire bundles. A schematical illustration of one of these tested metal sheets is shown in FIG. 5. As can be seen in FIG. 5, the shaping dies 30 have mostly made impressions or indentations 74 indicating that the tips 52 of those shaping dies 30 are in good working order. However, two shaping dies did not made contact with metal sheet 72, indicated by phantom impressions 76, thereby indicating at least those shaping dies corresponding to phantom impressions 76 need to be repaired or replaced.

The metal sheet 72 utilized could be any thin metal sheet such as a 0.5 to 5 mil thick sheet of copper, tin, aluminum, gold or lead, just to name a few. However, it is preferred that a MYLAR polycarbonate material sandwich consisting of clear MYLAR (e.g., 2 mil thick) and aluminized MYLAR (e.g., comprising a clear MYLAR sheet 0.5 mil thick with a 50–250 Å coating of aluminum) be used as the thin metal sheet. The aluminized MYLAR may additionally be replaced by a thin (e.g., 0.5 mil thick) layer of opaque material. The sandwich should be assembled such that the clear MYLAR is against the interconnect device assembly 34 and the aluminized MYLAR is against the working side 20 of the stripper plate 16. To avoid contamination of the shaping dies 30 with aluminum residue, it is most preferred that the aluminized side of the aluminized MYLAR is placed against the clear MYLAR which serves as a backup material allowing the thin aluminized MYLAR sheet to be penetrated by the tips 52 of the shaping die 30 instead of just being stretched out of planarity.

The advantage of the aluminized MYLAR is that it can be easily inspected using a microscope with bottom illumination, giving a dark background with bright spots appearing where the tips 52 have penetrated the aluminized MYLAR. This inspection could be performed using automatic image recognition equipment. As an interconnect device assembly 34 can have 1500 or more resilient wire bundles 38, thereby requiring a corresponding number of shaping dies 30, inspection of the aluminized MYLAR by automatic image recognition equipment would be preferred.

Figure 6:
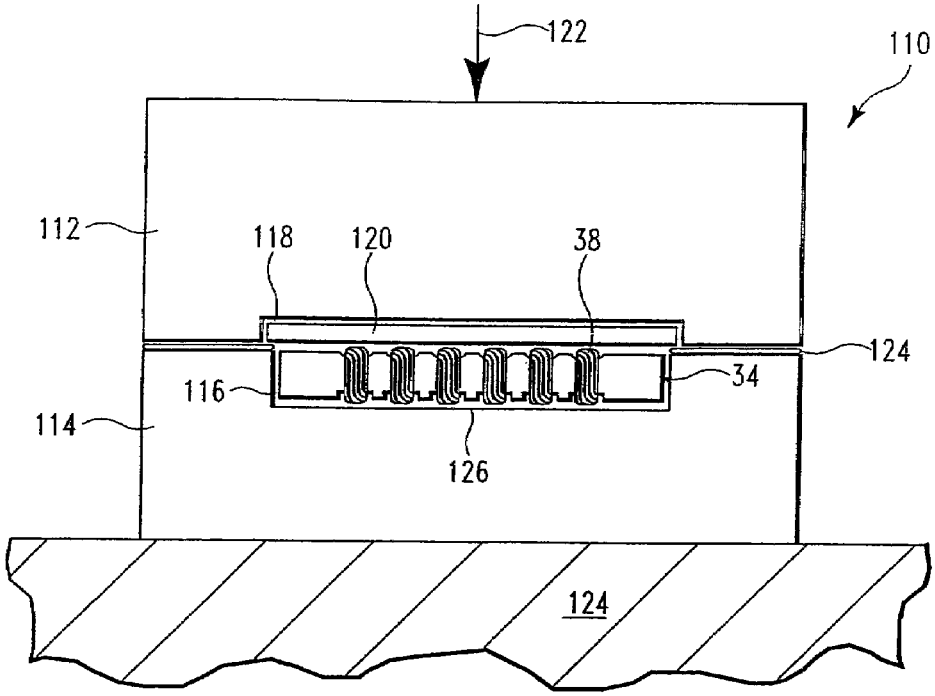
FIG. 6 is a partial cross-sectional view of a second fixture for use in the assembly of interconnect devices.

Referring now to FIG. 6, there is shown an alternative interconnect device assembly fixture 110 comprising die block 114 having a cavity 116 for receiving interconnect device assembly 34, die block 112 having a cavity 118 for receiving flat plate 120. Die block 114 sits on table 124 or other rigid surface. Once the interconnect device assembly fixture 110 is fully assembled as shown in FIG. 6, there is a gap 124 between die blocks 112 and 114. In operation, a force 122 is exerted on the interconnect device assembly fixture 110 which causes resilient wire bundles 38 to be compressed between flat surface 126 of cavity 116 and flat plate 120, thereby flattening the ends 40, 42 of resilient wire bundles 38 into a dog bone shape as shown in FIG. 7B as well as centering the resilient wire bundles 38 within carrier 36 in the Z (vertical) direction so that the resilient wire bundles 38 protrude by equal amounts above and below the surface of the carrier 36.

While the interconnect device assembly fixtures 10, 110 can be used separately, in a preferred embodiment of the present invention, the interconnect device assembly fixtures 10, 110 can be used together to achieve the most advantageous results. Thus, interconnect device assembly 34 may first be worked on in interconnect device assembly fixture 110, followed by interconnect device assembly fixture 10 and, most preferably, another application of interconnect device assembly fixture 110.

It has been found that retention of resilient wire bundles 38 within carrier 36 of interconnect device assembly 34 is improved by the application of interconnect device assembly fixture 110, is improved more so by the application of interconnect device assembly fixture 10 and is improved most by the combined application of interconnect device assembly fixtures 10, 110 as explained above.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

What is claimed is:

1. A method of assembling an interconnect device, the method comprising the steps of:

obtaining a resilient wire bundle having first and second ends and a carrier having a perforation for receiving the resilient wire bundle and a resilient wire bundle in the perforation;

placing the carrier having the resilient wire bundle in an interconnect device assembly fixture having a shaping die;

contacting the first and second ends of the resilient wire bundle with the shaping die while in the interconnect device assembly fixture so as to increase a cross-sectional area of the resilient wire bundle so as to form the resilient wire bundle into a dog bone shape and retain the resilient wire bundle in the perforation; and removing the carrier having the resilient wire bundle from the interconnect device assembly fixture and from contact with the shaping die.

2. The method of claim 1 wherein the step of contacting includes contacting the ends of the resilient wire bundle with the shaping die so as to indent the ends of the resilient wire bundle.

3. The method of claim 1 wherein the step of contacting includes contacting the ends of the resilient wire bundle with the shaping die so as to flatten the ends of the resilient wire bundle.

4. The method of claim 1 wherein the step of contacting comprises a first step of contacting the ends of the resilient wire bundle with the shaping die so as to flatten the ends of the resilient wire bundle, a second step of contacting the ends of the resilient wire bundle with the shaping die so as to indent the ends of the resilient wire bundle, and a third step of contacting the ends of the resilient wire bundle with the shaping die so as to flatten the ends of the resilient wire bundle.

5. The method of claim 1 further comprising step of testing the shaping die prior to obtaining a resilient wire bundle, the step of testing including placing the carrier in the interconnect device assembly fixture, inserting a metal sheet between the shaping die and the carrier, contacting the metal sheet with the shaping die so as to emboss the metal sheet and examining the embossed metal sheet to determine a condition of the shaping die and if the shaping die make contact with the metal sheet.

6. The method of claim 5 wherein the metal sheet comprises a metallized nonmetallic material.

7. The method of claim 1 further providing a plurality of perforations and resilient wire bundles with each perforation corresponding to a resilient wire bundle, a plurality of shaping dies and wherein the step of contacting includes contacting the first and second ends of the resilient wire bundles with the shaping dies so as to increase the cross-sectional area of each of the resilient wire bundles so as to form each of the resilient wire bundles into a dog bone shape and retain the resilient wire bundles in the perforations.

8. The method of claim 1 further providing a plurality of perforations and resilient wire bundles with each perforation corresponding to a resilient wire bundle, a plurality of shaping dies and wherein the step of contacting includes contacting the first and second ends of each of the resilient wire bundles with a corresponding pair of shaping dies so as to increase the cross-sectional area of each of the resilient wire bundles so as to form each of the resilient wire bundles into a dog bone shape and retain the resilient wire bundles in the perforations.

9. The method of claim 1 further including step after removing the carrier from the interconnect device assembly fixture of assembling the carrier with the resilient wire bundle formed into a dog bone shape between a pair of circuit boards so tat the resilient wire bundle makes electrical contact between the pair of circuit boards.

* * * * *